US009470056B2

(12) United States Patent
Armstrong

(10) Patent No.: US 9,470,056 B2
(45) Date of Patent: Oct. 18, 2016

(54) FIBRE COMPOSITE ROD FISHING TOOL

(71) Applicant: C6 TECHNOLOGIES AS, Stavanger (NO)

(72) Inventor: Kenny Armstrong, Stavanger (NO)

(73) Assignee: C6 TECHNOLOGIES AS, Stavanger (NO)

( * ) Notice: Subject to any disclaimer, the term of this patent is extended or adjusted under 35 U.S.C. 154(b) by 0 days.

(21) Appl. No.: 14/772,649

(22) PCT Filed: Mar. 7, 2014

(86) PCT No.: PCT/NO2014/050030
§ 371 (c)(1),
(2) Date: Sep. 3, 2015

(87) PCT Pub. No.: WO2014/178722
PCT Pub. Date: Nov. 6, 2014

(65) Prior Publication Data

US 2016/0010416 A1 Jan. 14, 2016

(30) Foreign Application Priority Data

Apr. 29, 2013 (NO) ..... 20130582

(51) Int. Cl.
*E21B 31/12* (2006.01)
*E21B 31/18* (2006.01)

(52) U.S. Cl.
CPC ..... *E21B 31/125* (2013.01); *E21B 31/18* (2013.01)

(58) Field of Classification Search
CPC ..... E21B 31/18; E21B 31/125; E21B 31/20
See application file for complete search history.

(56) References Cited

U.S. PATENT DOCUMENTS 1,306,497 A 6/1919 Monroe
1,530,013 A 3/1925 Robison
1,640,847 A * 8/1927 Neilson ..... E21B 31/18 294/86.31
2,285,838 A * 6/1942 Rea ..... E21B 31/18 294/86.17
2,559,315 A * 7/1951 Osmun ..... E21B 31/18 294/86.17
2,945,720 A * 7/1960 Osmun ..... E21B 31/18 294/86.17
3,124,023 A * 3/1964 Marquis ..... E21B 19/161 81/186
3,191,981 A * 6/1965 Osmun ..... E21B 31/18 294/86.31
5,149,163 A 9/1992 Pruitt
5,765,638 A * 6/1998 Taylor ..... E21B 31/18 166/115
7,083,209 B2 * 8/2006 Leman ..... E21B 31/18 294/86.17
7,191,840 B2 * 3/2007 Pietras ..... E21B 19/00 166/380
2004/0216924 A1 * 11/2004 Pietras ..... E21B 19/00 175/57
2011/0114317 A1 * 5/2011 Streater, Jr. ..... E21B 31/18 166/301
2016/0010416 A1 * 1/2016 Armstrong ..... E21B 31/18 166/99

FOREIGN PATENT DOCUMENTS

GB 2 04937 A 3/1983

* cited by examiner

*Primary Examiner* — Jennifer H Gay
(74) *Attorney, Agent, or Firm* — Birch, Stewart, Kolasch & Birch, LLP

(57) ABSTRACT

A fibre composite rod fishing tool includes a ring base with an axis and provided with peripherally arranged, axially extending radially resilient arms with slips with a common axial bore being tapered-off towards a rod receiving aperture opposite of said ring base, said common axial bore provided with teeth of common radial cutting depth, said teeth's engaging edge having the tapering off of the common axial bore, so as for the outer set of teeth's engaging edge to be most blunt, and each consecutive set of teeth's engaging edge extending higher and being sharper inwards toward the common axis, as counted in the direction away from said rod receiving aperture.

3 Claims, 5 Drawing Sheets

FIBRE COMPOSITE ROD FISHING TOOL

The invention is a composite rod fishing tool, i.e. a fishing tool for composite rod. The composite rod may be a carbon fibre reinforced cable for use in a petroleum well.

BACKGROUND ART

Fishing tools for engaging debris in petroleum wells are mounted on a lower end of a drillstring or tubing and are pushed onto an upward directed free end or fishing neck of the debris to be engaged. The debris may be a metal tool, a nut, a bolt. If a fibre composite cable is broken its upward directed end may be engaged. A broken fibre composite cable is vulnerable to becoming more splintered or flaked at its end if a fishing tool with sharp teeth is forced onto the broken end. The present tool solves part of this problem.

BRIEF SUMMARY

The above technical problem is relieved by a fishing tool according to claim 1.

FIGURE CAPTIONS

Figure 1:
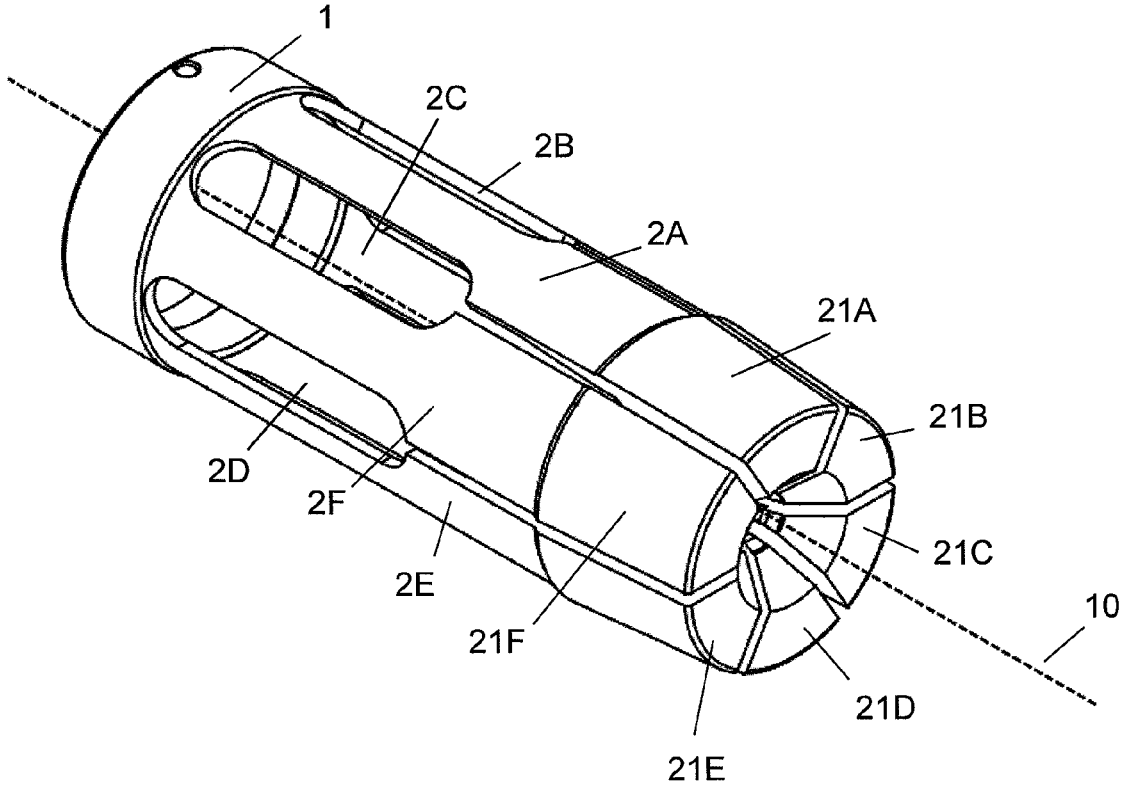
FIG. 1 is an isometric view of the fishing tool according to the invention having a rod receiving aperture (23) formed by a circularly arranged inward facing slips (21) at its right end. The aperture is heavily chamfered so as for guiding the end of a fibre composite rod cable into the aperture.
Figure 2:
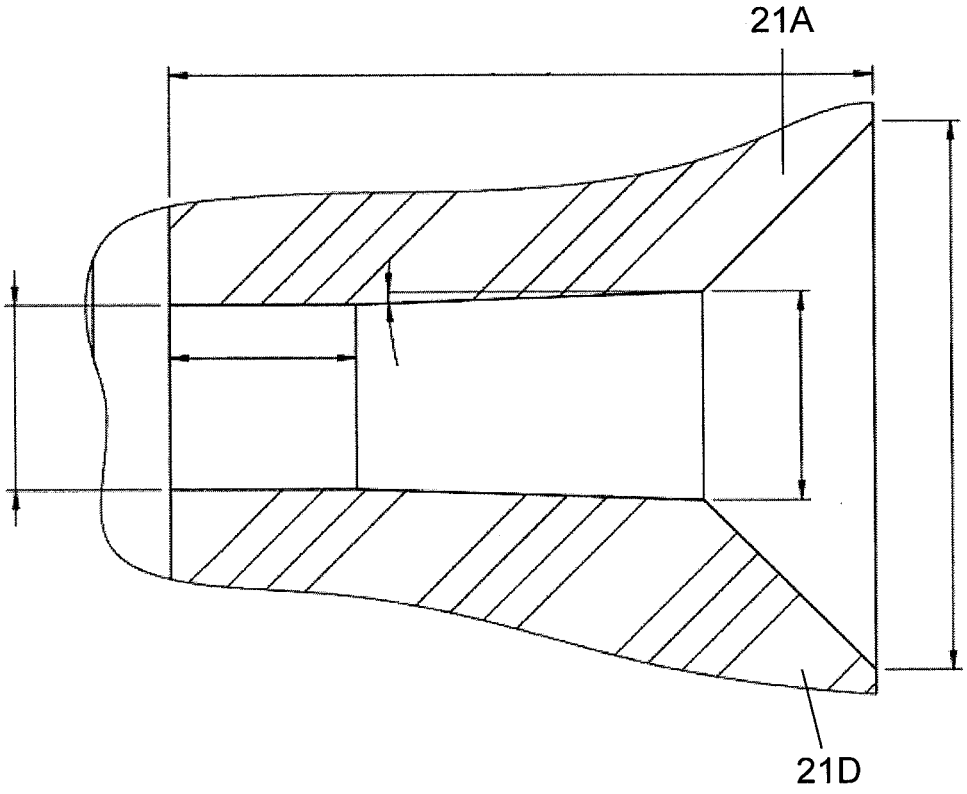
FIG. 2 is a section view of the part of the slips comprising the rod receiving aperture to the common axial bore (22). A clear tapering-off of the common axial bore is illustrated before teeth are formed to a common radial depth from this basis.
Figure 3:
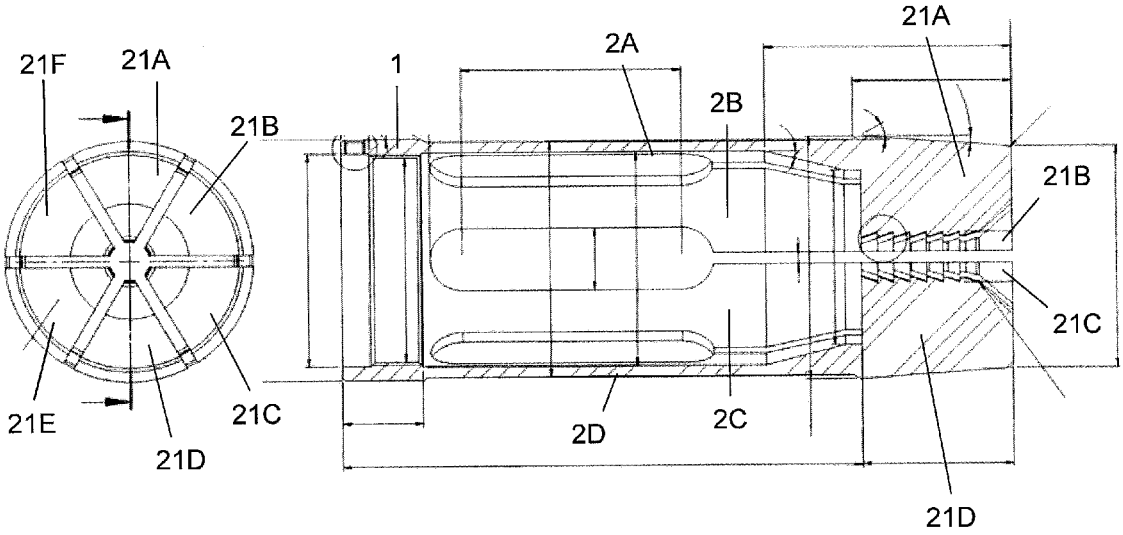

FIG. 3 comprises an end view of the fishing tool according to the invention to the left, and a combined cross-section and partial view to the right.

Figure 4:
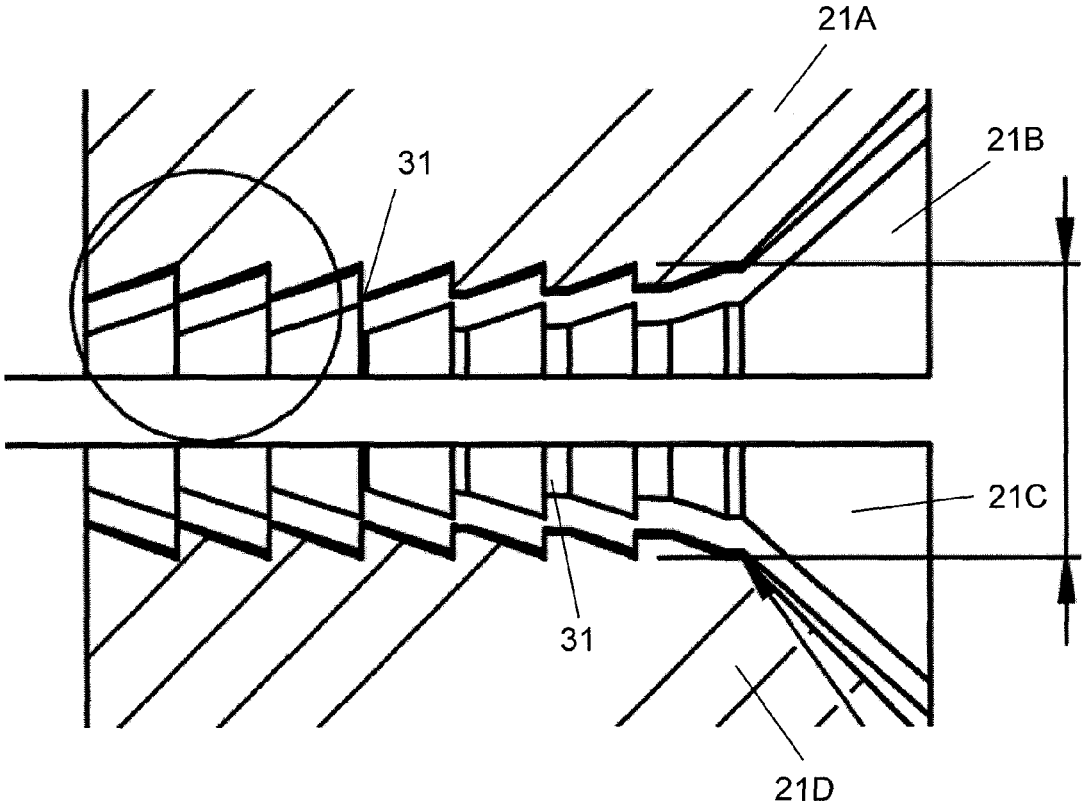

FIG. 4 is an enlarged portion of the part of FIG. 3 which shows the central bore of the combined inward facing slips, with cut-out teeth to a common radial depth, and with the engaging surfaces of each tooth in the tapered-off portion of the central bore being less and less sharp as counted in the direction towards the receiving aperture which faces towards the right side in this illustration. Please notice that the upper and lower slips (21A, 21D) with the upper and lower set of teeth in this drawing is seen almost only in a cross-section, while the views of the slips (21B, 21C) are not sections, and show the engaging surfaces/edges (31) in perspective.

Figure 5:
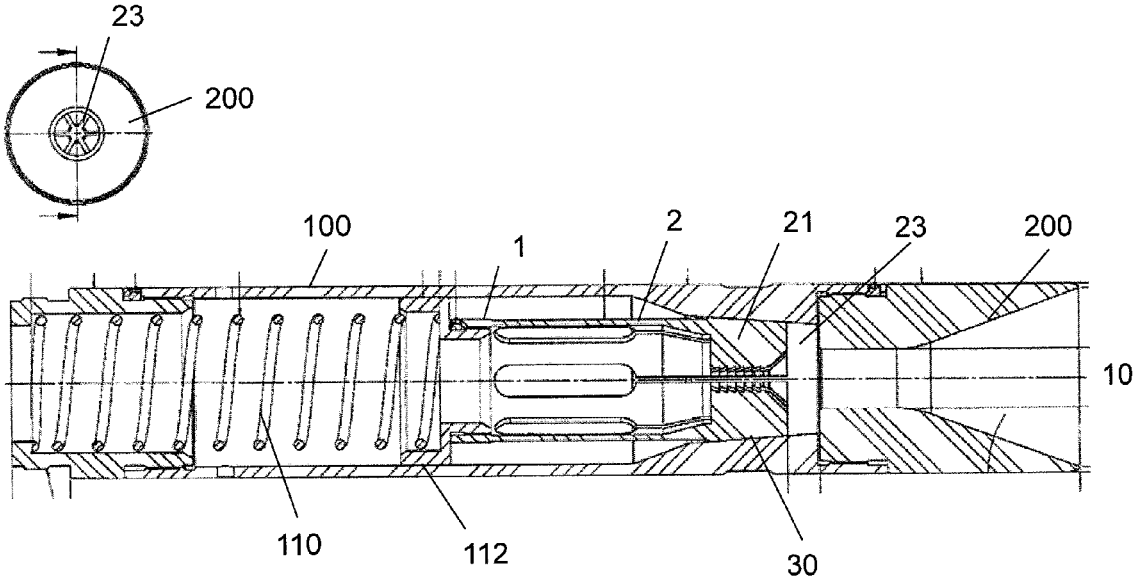

FIG. 5 is a section through the fishing tool inserted into a spring-loaded holder in a housing (100) wherein the rod fishing tool's slips slightly tapered outward rim are held against the housing's (100) corresponding funnel (30). When the teeth have gripped about a fibre composite rod and the tool starts pulling the rod, the funnel (30) will tighten the slips (21A, . . . 21F) will increase their radial inward force on the fibre composite rod. An entry funnel (200) is arranged at the very nose tip end of the housing to guide an end of a fibre composite rod into the receiving aperture (23).

EMBODIMENTS OF THE INVENTION

The invention is a fibre composite rod fishing tool comprising a ring base (1) with an axis (10) and provided with peripheric ally arranged, axially extending radially resilient arms (2, 2A, 2B, 2C, 2D, 2E, 2F) with slips (21) with a common axial bore (22) being tapered-off towards a rod receiving aperture (23) opposite of said ring base (1), said common axial bore (22) provided with teeth (3) of common radial cutting depth, said teeth's (3) engaging edge (31) having the tapering off of the common axial bore (22), so as for the outer set of teeth's (3) engaging edge (31) to be most blunt, and each consecutive set of teeth's (3) engaging edge (31) extending higher and being sharper inwards toward the common axis (10), as counted in the direction away from said rod receiving aperture (23).

FIG. 5 is a section through the fishing tool inserted into a spring-loaded holder in a housing (100) wherein the rod fishing tool's slips slightly tapered outward rim are held against the housing's (100) corresponding funnel (30). the fishing tool (1) is mounted on a sliding piston (112) which is loaded by a spring (110) in the direction of the funnel (30). When the teeth have gripped about a fibre composite rod and the tool starts pulling the rod, the funnel (30) will tighten the slips (21A, . . . 21F) will increase their radial inward force on the fibre composite rod. A bottom sub with an entry funnel (200) is arranged forming the very nose tip end of the housing to guide an end of a fibre composite rod into the receiving aperture (23).

Thus the tool provides slips with teeth having an increasingly sharpened and narrowed bite on a fibre composite rod with increasing receiving depth of said fibre composite rod into the receiving aperture of said tool. The importance of the blunt teeth near the receiving aperture is that they do not cut any carbon fibres as the sharp teeth will. Hence the sharp teeth are at the top of the gripping area, so after the blunt teeth have been loaded the sharp teeth will not carry the entire load. This preserves the fibres of the engaged fibre composite rod cable better than a fishing tool with non-tapered slips, thus provides a better and less damaging grip on the fibre composite rod cable to be fished.

The invention claimed is:

1. A fibre composite rod fishing tool comprising a ring base with an axis and provided with peripherally arranged, axially extending radially resilient arms with slips with a common axial bore being tapered-off towards a rod receiving aperture opposite of said ring base, wherein said common axial bore is provided with a plurality of sets teeth of common radial cutting depth, an engaging edge of each of said teeth having the tapering off of the common axial bore, an engaging edge of an uppermost set of the plurality of sets of teeth being blunt, and each consecutively lower set of the plurality of sets of teeth having an engaging edge extending higher and being sharper inwards toward the common axis, in the direction away from said rod receiving aperture than an upwardly adjacent set of the plurality of sets of teeth.

2. The fibre composite rod fishing tool of claim 1, wherein said ring base is mounted on a sliding piston in a housing, wherein the tapered outward rim of the slips of the rod fishing tool are held against a corresponding funnel, and wherein said ring base is mounted on a sliding piston loaded by a spring in the direction of the funnel.

3. The fibre composite rod fishing tool of claim 2, wherein said housing is provided with a bottom sub with an entry funnel arranged forming the tip end of the housing to guide an end of a fibre composite rod into the receiving aperture.

* * * * *